US006038980A

United States Patent [19]

Bittar et al.

[11] Patent Number: 6,038,980

[45] Date of Patent: Mar. 21, 2000

[54] TRANSFERRING FREIGHT OR PASSENGER CABS BETWEEN MOVING BOGIES

[75] Inventors: Joseph Bittar, Avon; Frederick H. Barker, Bristol; Anthony Cooney, Unionville; David I. Perl, Simsbury; Richard E. Peruggi, Glastonbury; Michael D. Silverberg, Huntington, all of Conn.

[73] Assignee: Otis Elevator, Farmington, Conn.

[21] Appl. No.: 09/023,640

[22] Filed: Feb. 13, 1998

[51] Int. Cl.[7] ..... B61K 1/00

[52] U.S. Cl. ..... 104/20

[58] Field of Search ..... 104/18, 20, 27, 104/28, 29, 48; 258/9

[56] References Cited

U.S. PATENT DOCUMENTS

| | | | |
|---|---|---|---|
| 2,693,770 | 11/1954 | Hubscher | 104/128 |
| 3,734,025 | 5/1973 | Shoemaker | 104/20 |
| 3,823,671 | 7/1974 | Straumsnes | 104/20 |
| 3,958,512 | 5/1976 | Stankiewicz | 104/20 |
| 4,425,851 | 1/1984 | Long | 104/20 |

*Primary Examiner*—Mark T. Le

[57] ABSTRACT

Cabs, such as passenger and freight cabs, are transferred from one horizontal transport bogie that is moving along a track to another horizontal transport bogie moving at the same speed on an adjacent track. The cab may be transferred from one train or shuttle of moving bogies to another train of moving bogies, or may be transferred from a train of moving bogies to an auxiliary shuttle or bogie on a siding so as to permit the cab to be brought to a stop, either to allow transfer of passengers, to be moved into the car frame of an adjacent elevator for vertical transport within the building, or to simply await the coming of another train, traveling in either the same or in opposite direction, to which the cab may then be transferred.

11 Claims, 9 Drawing Sheets

TRANSFERRING FREIGHT OR PASSENGER CABS BETWEEN MOVING BOGIES

TECHNICAL FIELD

This invention relates to transferring a cab, such as a freight and passenger cab, horizontally between one moving horizontal transport bogie and another moving horizontal transport bogie, to facilitate one cab making a stop without causing a train of transport bogies to also have to stop, or to transfer cabs from different origins to trains traveling to a variety of destinations, and the like.

BACKGROUND ART

Recent innovations in passenger transportation systems associated with buildings have included horizontally transferring elevator cabs between elevator car frames and horizontal transport bogies, as well as between car frames or bogies and loading/unloading platforms, such as passenger lobbies.

In larger systems, a number of passenger or freight cabs may be transported horizontally on corresponding bogies arranged end-to-end in a train, either to travel large distances within a single building, or more particularly, to transfer distances between different buildings of the same system.

DISCLOSURE OF INVENTION

Objects of the invention include moving one cab traveling on a train of cabs to a stopped position, such as at an elevator or a loading/unloading platform, and exchanging cabs between trains of cabs so as to permit cabs to reach appropriate destinations, without having to stop the trains for the cab transfers, as well as improved versatility in a horizontal transport system employing horizontally transferable passenger cabs.

According to the present invention, passenger cabs are transferred from one horizontal transport bogie to another horizontal transport bogie, while both bogies are moving in synchronism. In accordance with the invention, a cab may be transferred from a shuttle train of bogies to an individual bogie for deceleration to a stop, or from an individual bogie that has picked up the cab from a stop and has accelerated to synchronism with a shuttle train of bogies, thereby avoiding the necessity of stopping the entire train of horizontal transport bogies. In further accord with the invention, the cab may be transferred from one moving train of horizontal transport bogies to another moving train of horizontal transport bogies, thereby to alter the ultimate destination of the cab. In still further accord with the invention, cabs on each of a pair of trains of horizontal transport bogies may be exchanged, thereby to alter the destinations of both cabs. Cabs may be moved off one moving train, wait on a siding, and then be moved onto another moving train.

According to the invention in one form, cabs are transferred from one horizontal transport bogie to another on wheels which roll on rails disposed transversely on the bogies.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
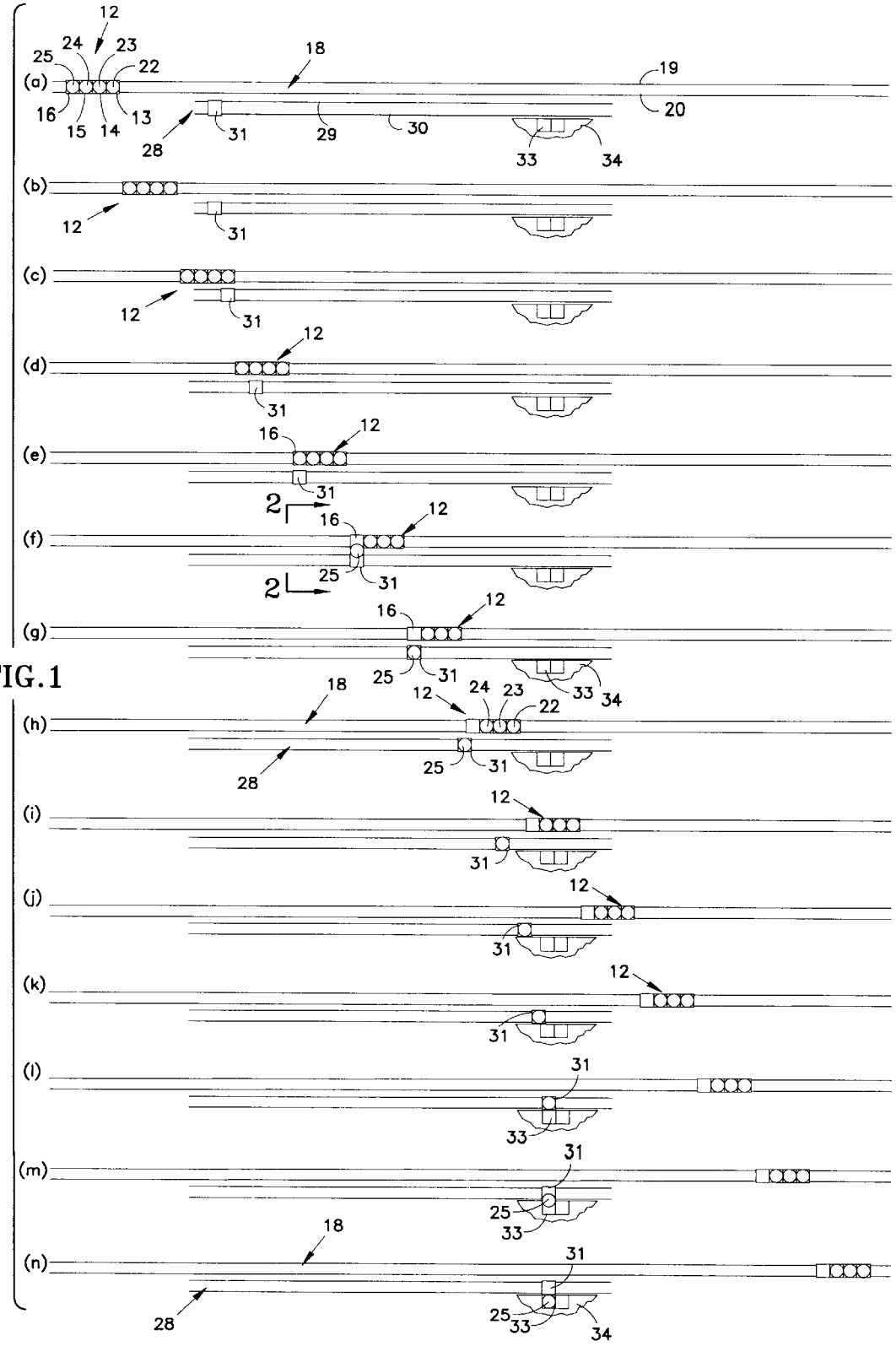
FIG. 1 is a series of simplified, stylized plan views of a horizontal transport bogie shuttle train track and an acceleration/deceleration track leading to a building having an elevator, illustrating the principles of a first aspect of the present invention.
Figure 2:
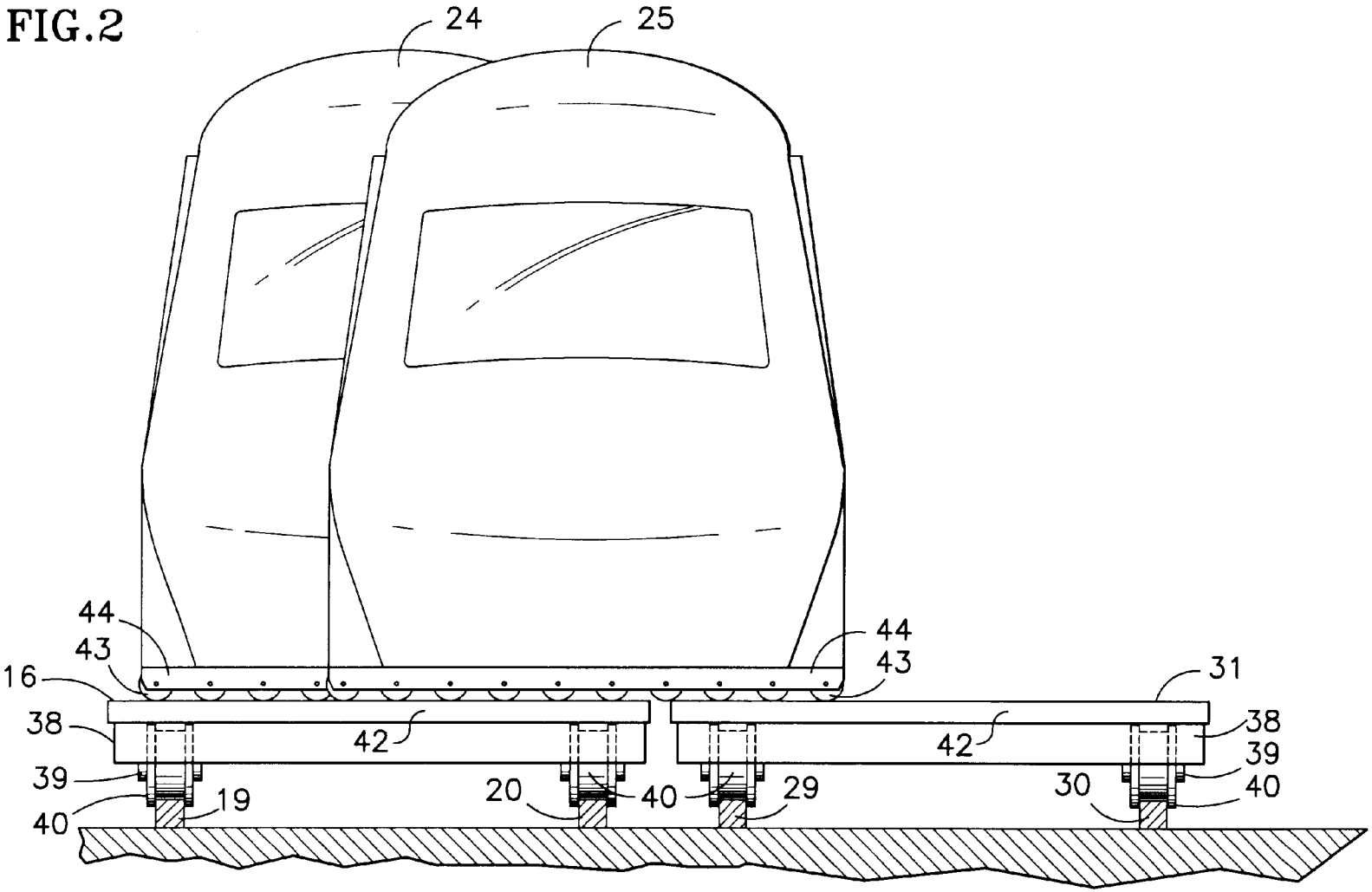
FIG. 2 is a rear elevation view of a cab being transferred from one bogie to another, taken on the line 2—2 in FIG. 1.

Referring to FIG. 1, a shuttle 12 comprising a series of horizontal transport bogies 13–16 (represented as squares in FIG. 1) connected together in the form of a train or shuttle, are traveling on a guideway 18 which, in the illustrative embodiment of FIGS. 1 and 2, may comprise a pair of tracks, 19 and 20, that lead between destinations for a plurality of horizontally transferable cabs 22–25 (represented as circles in FIG. 1). A second guideway 28 may include, in this embodiment, tracks 29, 30, extending only a short distance, that which is sufficient for a bogie 31 to accelerate to the speed of the shuttle 12 and to decelerate to a stop, which may be at an elevator 33 within a building 34. The guideway 18 comprises a main track and the guideway 25 comprises a siding.

In view (a), the shuttle 12 is proceeding along the guideway 18 at its normal cruise speed, which may be on the order of 12 meters per second, and the bogie 31 is at rest. When the shuttle 12 gets to the position with respect to the bogie 31 illustrated in view (b), the bogie 31 is given a command to commence executing an acceleration profile. The bogie continues to accelerate as the shuttle catches up with it, in view (c). As the bogie 31 approaches the speed of the shuttle 12, view (d), the shuttle has almost passed the bogie 31. In view (e), the bogie 31 is traveling at the same speed as the shuttle 12 and is adjacent to the bogie 16. In view (f), the cab 25 begins to transfer horizontally between the bogie 16 on the shuttle 12 and the bogie 31, as both bogies continue to travel along their respective tracks at the normal speed of the shuttle 12. When the cab 25 is fully loaded onto the bogie 31, view (g), the bogie 31 is given an instruction to commence a deceleration profile so as to bring it to rest in front of the elevator 33 within the building 34. In view (i), the shuttle 12 has cleared the bogie 31. In views (j) and (k), the bogie 31 continues to decelerate, and in view (l) the bogie 31 comes to rest adjacent to the elevator 33. In view (m), the cab 25 is being horizontally transferred from the bogie 31 to the car frame of the elevator 33. In view (n), the cab 25 is fully within the elevator 33. At that time, depending upon whether there are additional bogies on the acceleration/deceleration guideway 28, the bogie 31 may rest where it is, adjacent the elevator 33, it may be caused to return to the rest position near the other end of the guideway 28, as seen in view (b), or it may be caused to travel to a position to the right after elevator 33 where it could accelerate to pick up a leftward-moving cab.

The description of FIG. 1 thus far is of an empty bogie 31 which accelerates, receives a cab, decelerates to a stop, and then off-loads the cab. The rate of acceleration, views (b)–(e), can be higher than the rate of deceleration, views (g)–(l) because the empty bogie has less mass, and the bogie with a cab on it must account for passenger comfort. Of course, the process can work in reverse, and the cab 25 can be transferred from the car frame of the elevator 33 to the bogie 31, as in view (m), and then accelerate to meet the shuttle 12, as at view (g), so as to transfer the cab 25 from the bogie 31 to the bogie 16, as in view (f). Thereafter, the bogie would decelerate to its rest position, view (b). Of course, the bogie 31 may be caused to accelerate with a motion profile which will bring it to the speed of the shuttle 12 but adjacent one of the other bogies 13–15, instead of the bogie 16, so that it could receive one of the cabs 22–24. In addition to being able to reverse the process of FIG. 1 and accelerate a bogie from right to left so as to deliver a cab from the elevator 33 to the shuttle 12, if the guideway 28 were of an additional length, shuttles could be decelerated in a right to left direction, and accelerated in a left to right direction, in an obvious fashion.

Referring to FIG. 2, each of the bogies 13–16, 31 in this embodiment have a frame structure 38 supported on trucks 39 that have wheels 40. The frames 38 also support at least two rails 42 per bogie positioned in parallel with the rotational axes of the wheels 40, so as to permit transverse transfer of the cabs 22–25. The cabs in turn have a plurality of wheels 43 journaled to frames 44. The bogies 13–16 may take the form of those described in commonly owned copending U.S. patent application Ser. No. 08/749,120, filed on Nov. 14, 1996 provided only that the rails, the linear motors, and the position sensing waveguide be mounted transversely as in FIG. 2 hereof, rather than longitudinally as in said copending application. Similarly, the wheels 43 and frames 44 of the cabs 22–25 herein may take the form of the cab carriages of said copending application, with the possibility that perhaps more wheels might be required to permit smoothly transitioning the gap between the bogies 16, 31. On the other hand, if desired, instead of a linear electric motor as in said copending application, the cabs 22–25 may be transferred horizontally by the apparatus disclosed in a commonly owned copending U.S. patent application Ser. No. 08/663,869, filed on Jun. 19, 1996.

If desired, the bogies may be coupled together after they are properly aligned for a cab transfer. The coupling may take the form of an elevator cab-to-car frame lock disclosed in U.S. patent application Ser. No. 08/565,658 filed Nov. 29, 1995, or a cog coupler disclosed in U.S. patent application Ser. No. 08/822,370, filed Mar. 30, 1997, or any other suitable coupler.

Figure 3:
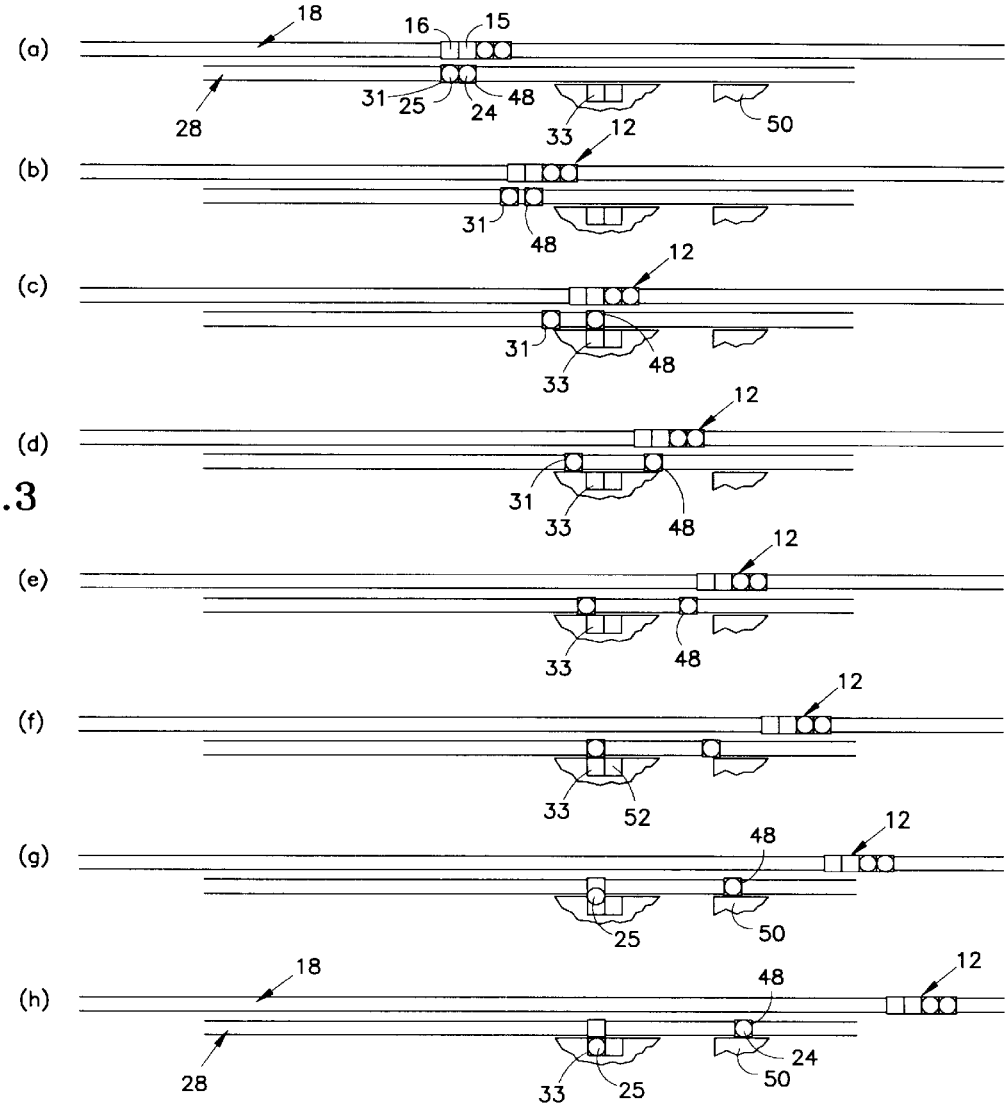
FIG. 3 is a series of simplified, stylized plan views of a system similar to FIG. 1, illustrating principles of the invention applied to a pair of cabs reaching different stops.

Referring to FIG. 3, the invention may be practiced with more than one bogie 31, 48 on the acceleration/deceleration guideway 28 so as to be able to deliver a cab 24 to a landing 50 which is positioned beyond the position of the elevator 33 along the guideway 28, while the cab 25 is delivered to the elevator 33. View (a) of FIG. 3 is similar to view (e) of FIG. 1: the bogie 31 has become aligned and synchronized with the bogie 16. In views (b) and (c), the bogie 31 has begun decelerating but the bogie 48 continues at the same speed as the shuttle 12; but in view (d) the shuttle 48 begins the deceleration profile, and then continues to decelerate in views (e) through (h) in the same fashion as the bogie 31 decelerates in views (b) through (f).

In FIG. 3, if desired, both bogies 31, 48 could begin decelerating in view (b) so that the bogie 31 would become adjacent to the elevator 33 at the same time that the bogie 48 would become adjacent to another elevator 52, in the time frame depicted in view (f).

Figure 4:
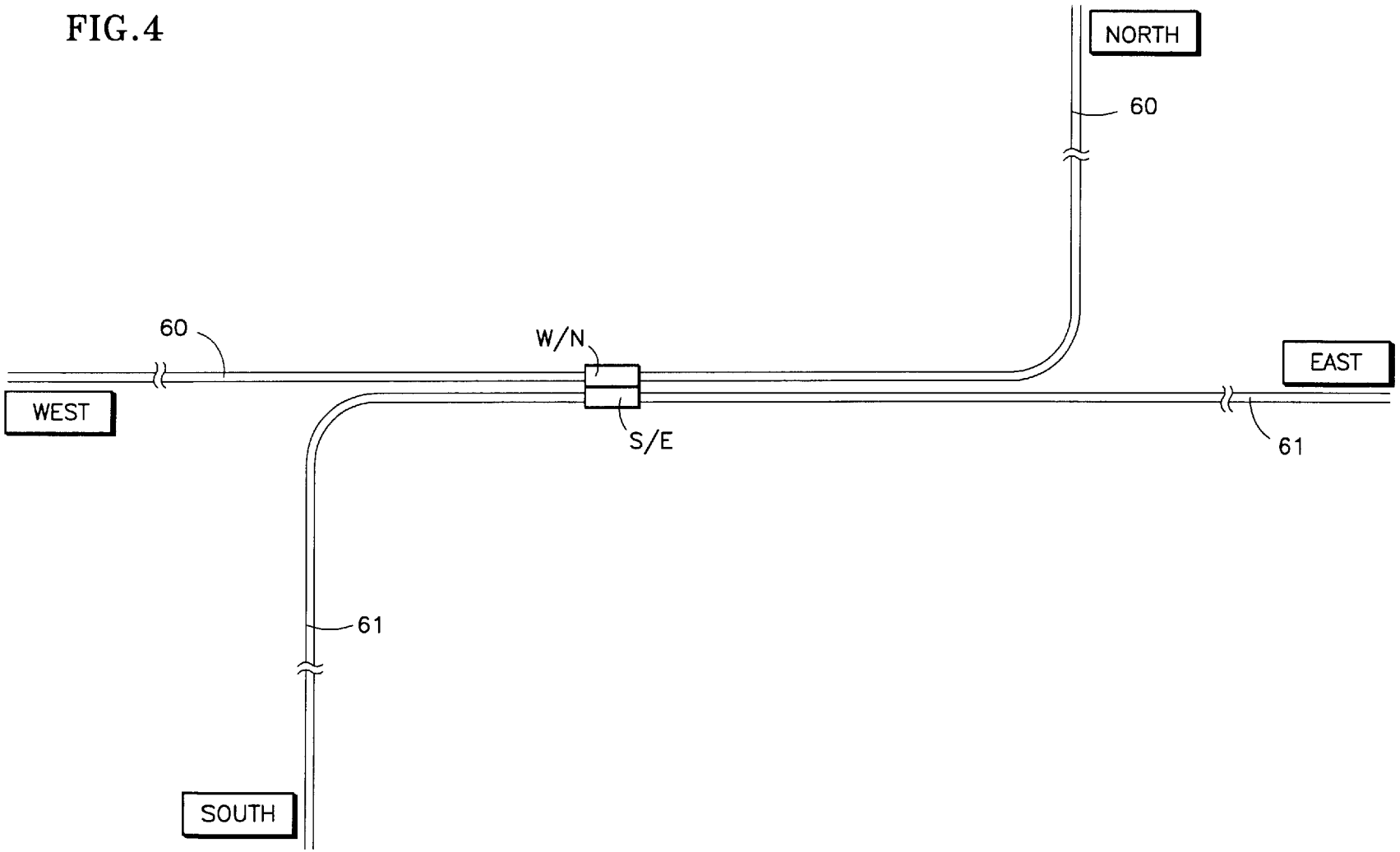
FIG. 4 is a diagrammatic plan view of a horizontal transport system in which additional aspects of the invention may be utilized.

FIG. 4 depicts a horizontal transport system in which transportation is provided between four terminals designated north, east, south and west. This is achieved with only two guideways 60, 61 because the invention can be used to transfer cabs from bogies on the shuttle W/N traveling on the guideway 60 between the west terminal and the north terminal and a shuttle S/E traveling on the guideway 61 between the south terminal and the east terminal. Thus a cab which starts out on the shuttle S/E heading for the east terminal may nonetheless be transferred onto the shuttle W/N to reach the north terminal.

Figure 5:
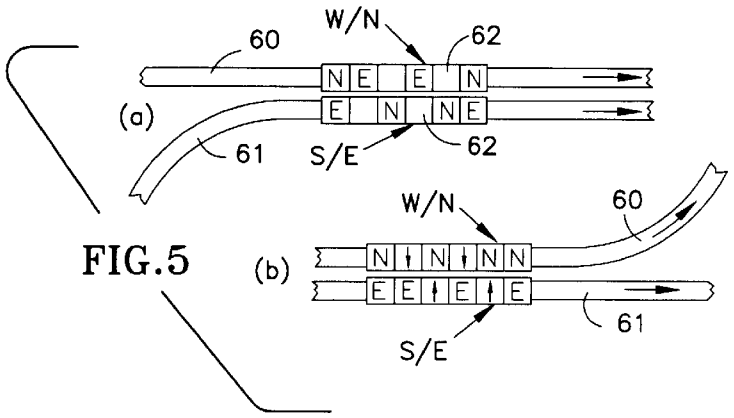
FIG. 5 is a pair of simplified, stylized plan views of a portion of the system of FIG. 4, illustrating one embodiment of the invention.

In FIG. 5, the simplest means of achieving this includes having shuttles W/N, S/E which each have as many empty bogies 62 as there are cabs which are to be transferred to it from the other shuttle. In FIG. 5, each bogie having a cab bound for the north terminal is designated with an "N", and each bogie carrying a cab destined for the east terminal is identified with an "E". The blank bogies have no cab thereon, and the bogies with an arrow thereon indicate a bogie which has just transferred a cab to a bogie on the other shuttle. In view (a) of FIG. 5, the shuttles on W/N, S/E have come adjacent to each other traveling at their normal cruise speed. As they travel along, cabs destined for the opposite terminals are transferred to the opposite shuttles as shown in view (b). And then each shuttle continues on its own guideway to the respective terminal (FIG. 4).

Figure 6:
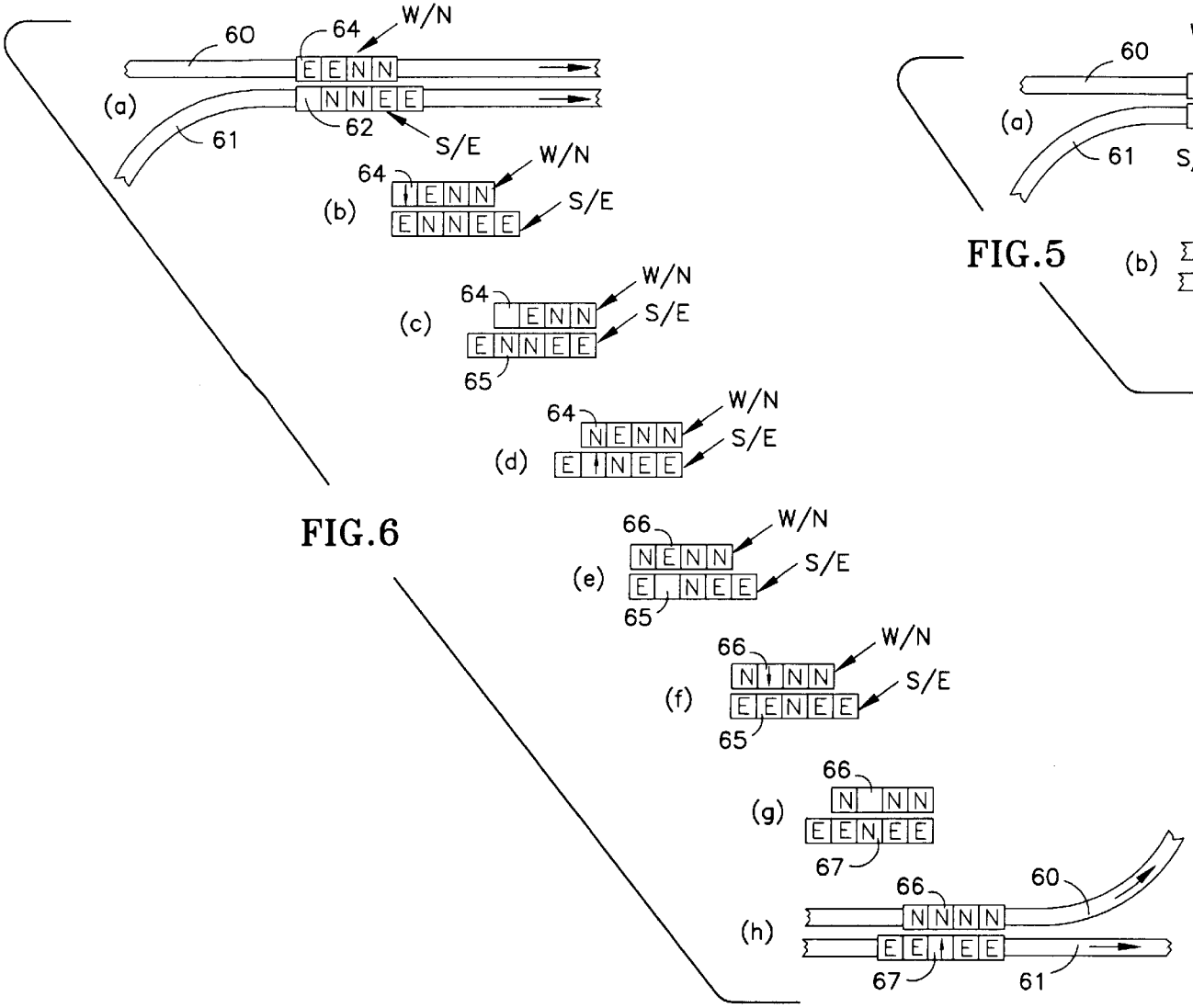
FIG. 6 is a series of simplified, stylized plan views of a portion of the system of FIG. 4, illustrating another embodiment of the invention.

FIG. 6 illustrates a method of transferring any number of cabs from one shuttle to another utilizing only one extra, initially empty bogie 62 (tracks 60, 61 are omitted in views (b)–(g) for clarity). In view (a), the shuttles WIN, S/E have become adjacent to each other, traveling at exactly the same speed, with the empty bogie 62 of the shuttle S/E aligned with a bogie 64 on the shuttle W/N bearing a cab which is destined for the east terminal. In view (b), the cab is transferred from the W/N shuttle to the S/E shuttle. In view (c), the S/E shuttle is allowed to decelerate momentarily and then reaccelerate to cruise speed so that it drops back by the length of one bogie, so as to position the newly emptied bogie 64 adjacent to a bogie 65 carrying a cab destined for the north terminal. In view (d), the cab is transferred from the bogie 65 of the shuttle S/E to the previously empty bogie 64 of the shuttle W/N. In view (e) the shuttle W/N is allowed to decelerate and then reaccelerate to cruise speed so that it will drop back by the distance of one bogie to a position in which a bogie 66 bearing a cab destined for the east terminal will be adjacent to the bogie 65 which was emptied in view (d). In view (f), the cab destined for the east terminal is transferred from the shuttle W/N to the previously empty bogie 65 on the shuttle S/E. In view (g), the shuttle S/E is allowed to decelerate and then reaccelerate to cruise speed so that it will drop back by the distance of one bogie to a position in which a bogie 67 bearing a cab for the north terminal is adjacent to the now-empty bogie 66. In view (h), a cab destined for the north terminal is transferred from the bogie 67 to the bogie 66, thereby completing the transfer of cabs onto shuttles heading for the proper destinations.

Figure 7:
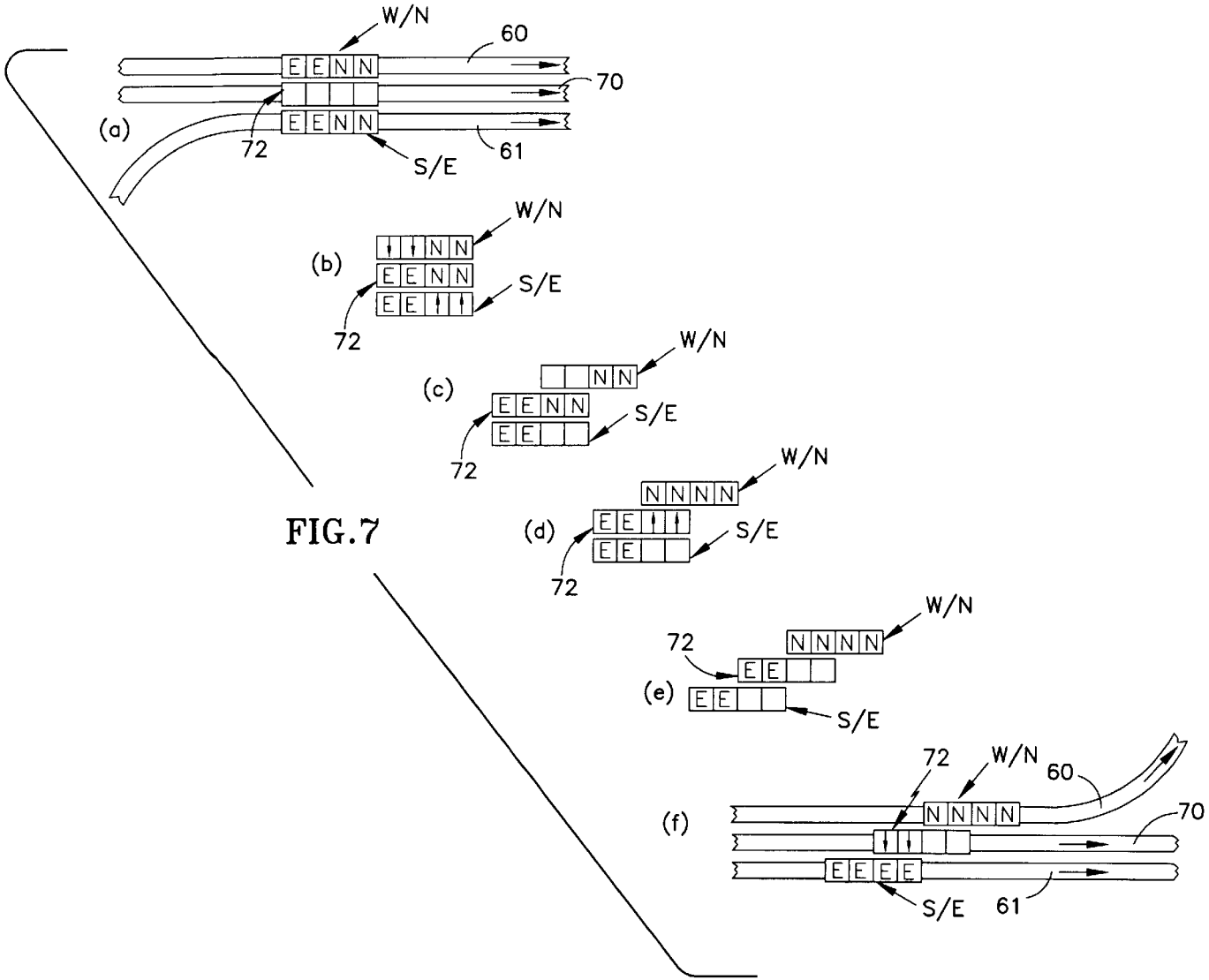
FIGS. 7 and 8 are each a series of simplified, stylized plan views of a portion of a transport system, modified from that of FIGS. 4–6, illustrating additional embodiments of the invention.

In FIG. 7, a system which may be similar to that described with respect to FIGS. 4–6, has a siding 70 (similar to the tracks 28 in FIG. 1) disposed between the main tracks 60, 61. The siding 70 is of limited extent, being only long enough to permit accelerations and decelerations required in order to transfer bogies at the normal cruise speed of the shuttles W/N, S/E. In views (b)–(e) of FIG. 7, the tracks 60, 61, 70 are omitted for clarity. In FIG. 7, transfer is effected by allowing a pair of cabs to move from each of the shuttles W/N, S/E onto an auxiliary shuttle 72, as view (b). In view (c), the auxiliary shuttle 72 and the shuttle S/E have decelerated and then reaccelerated so as to drop back by the length of two bogies, thereby permitting transfer of two cabs from the auxiliary bogie 72 into the W/N bogie, as in view (d). In view (e), the shuttle S/E has decelerated and reaccelerated so as to drop back by the length of two bogies so as to permit transferring the last two cabs from the auxiliary shuttle 72 to the shuttle S/E, as in view (f). The tracks 60, 61 need not be adjacent to each other; the siding 70 needs to be adjacent to each track 60, 61 at some point.

Figure 8:
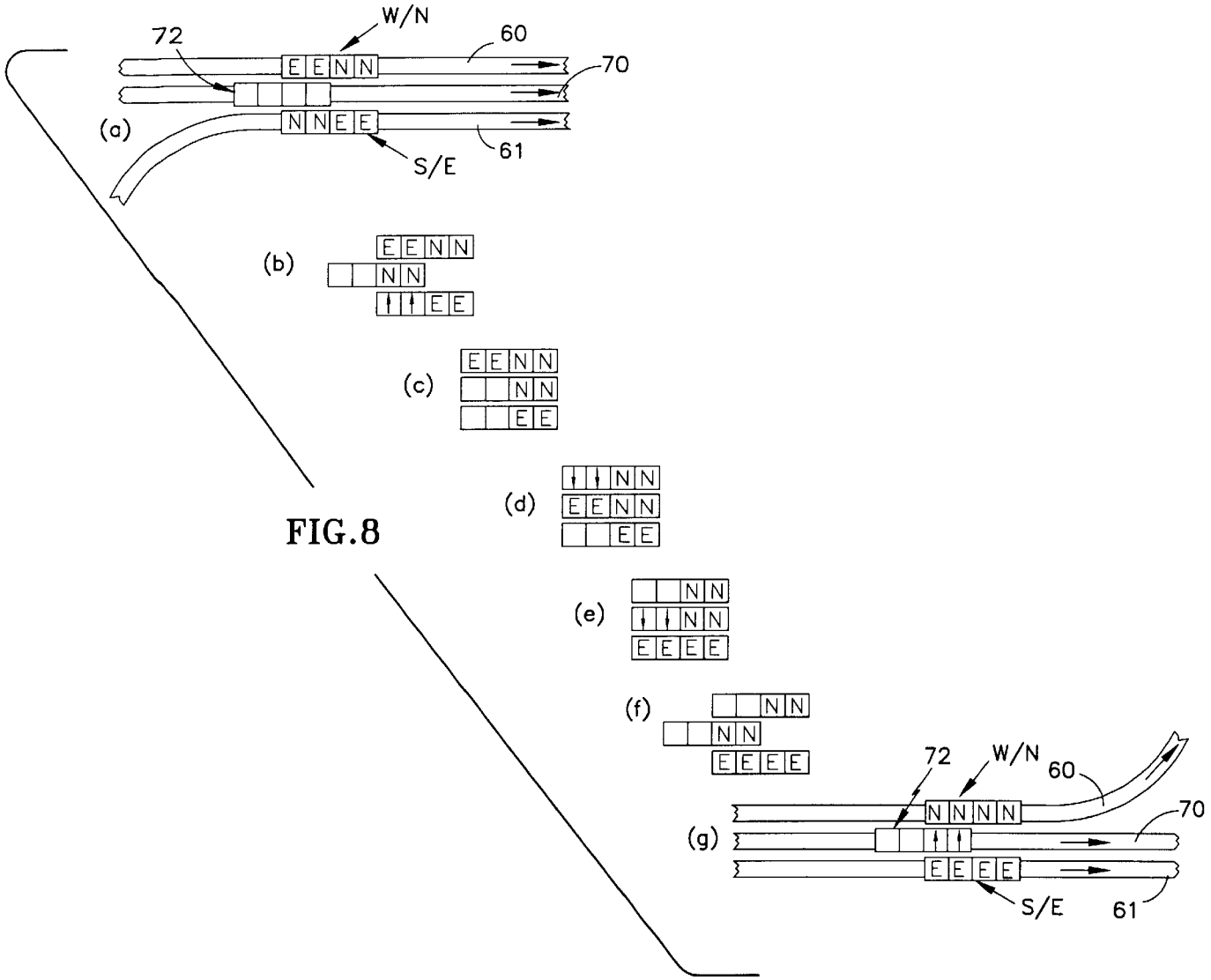

FIG. 8 illustrates a similar situation except that in FIG. 8, the main shuttles W/N, S/E retain cruise speed at all times, all of the position adjustment being accomplished by the auxiliary bogie 72, in a fashion which is obvious in view of FIG. 8 and the descriptions hereinbefore.

The system of FIGS. 7 and 8 may be preferable to that of FIGS. 4–6 since the accurate adjustment of speed and position can be made by commanding the bogies on the auxiliary track, rather than on the main track, and to facilitate additional types of transfers as are described with respect to FIGS. 9 and 10 hereinafter.

Figure 9:
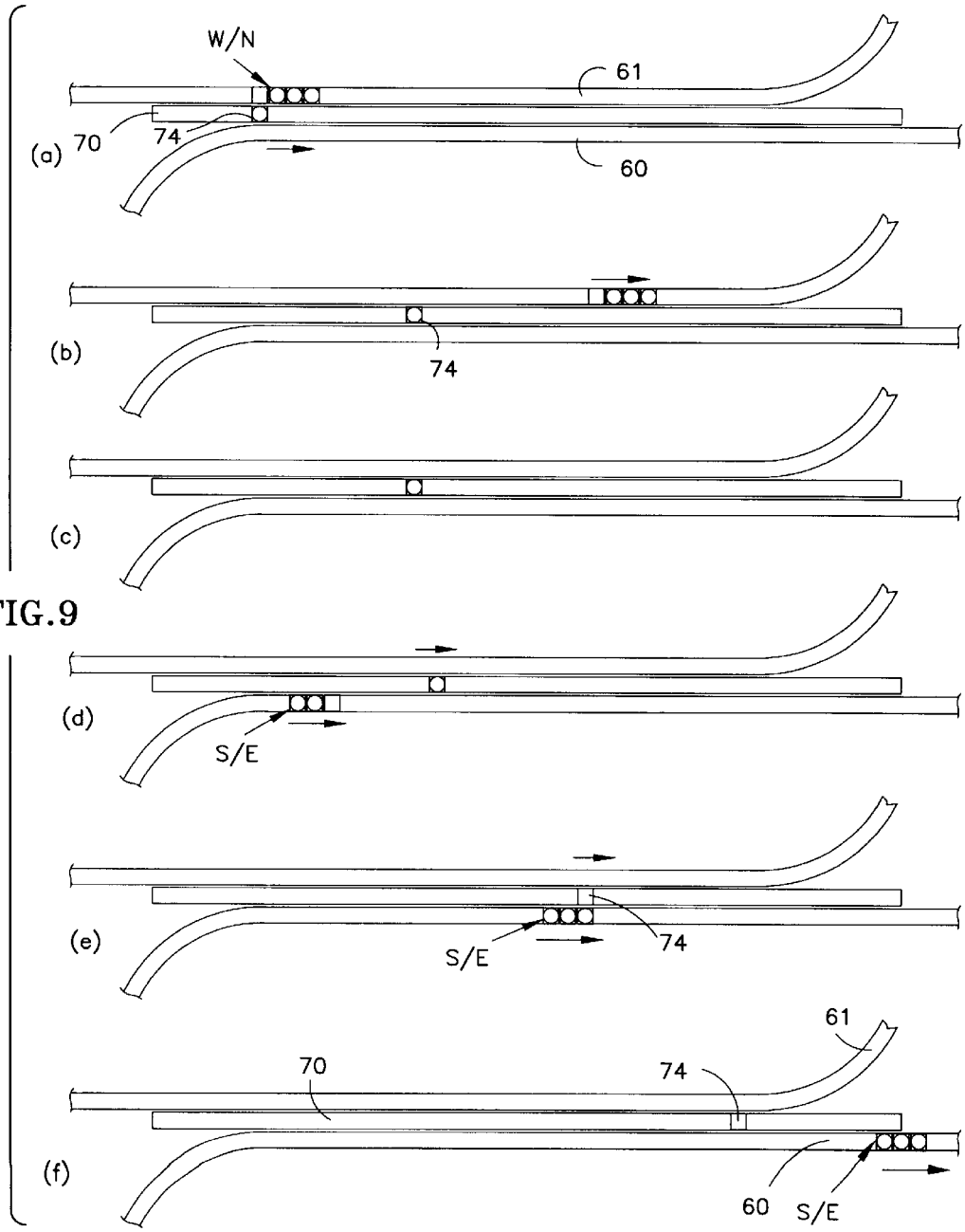
FIGS. 9 and 10 are each a series of simplified, stylized plan views of a transport system similar to FIGS. 7 and 8, illustrating transfer of a bogie to a siding to await further transfer to a shuttle going in the same direction and going in the opposite direction, respectively.
Figure 10:
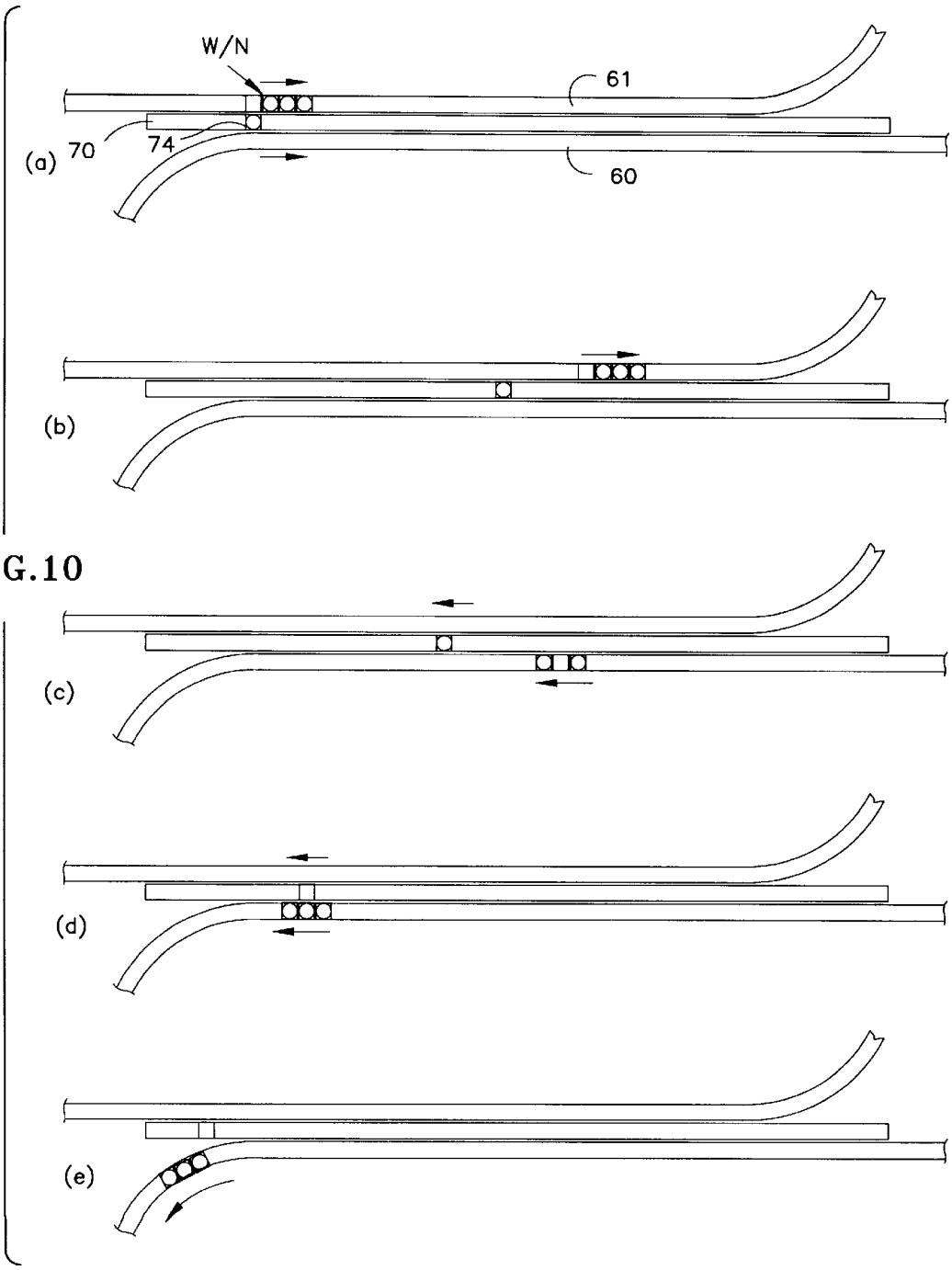

FIG. 9 illustrates a cab being moved from a train onto a bogie on a siding, view (a), after which the bogie comes to rest, view (b). The cab waits on a bogie, view (c), until another train, S/E, appears, view (d), at which time the bogie begins to accelerate. When the cab synchronizes with the train, view (e), the cab is transferred from the bogie to the train, and then the bogie decelerates to a stop, view (f), to await its next task. Views (a)–(e) of FIG. 10 illustrate an operation similar to that of FIG. 9, except the cab starts out coming from the west, and its transferred to a train traveling in an opposite direction to end up in the south.

The invention may be used to service, for instance, a passenger station, having a siding track and two (or more) bogies, in which a cab of departing passengers is exchanged (on a train) for a cab of arriving passengers. The guideways or tracks may comprise rails, concrete monorail guideways, or any other form of guideways or suitable pathways.

The foregoing is descriptive of exemplary operations which may be performed utilizing the present invention; of course, many other operations can readily be performed, as should be apparent from the foregoing descriptions.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A transport system comprising:

a first track extending between a pair of destinations;

a second track disposed immediately adjacent said first track;

a plurality of horizontal transport bogies, at least one on each track, each having transverse rails disposed thereon; and a plurality of passenger cabs, at least one of said passenger cabs having wheels for moving on said transverse rails, said passenger cabs and said bogies comprising means for moving said passenger cabs on said transverse rails from one of said bogies traveling on one of said tracks at a given speed to another one of said bogies traveling on the other of said tracks at said given speed adjacent to said one bogie and with the rails of said bogies aligned with each other.

2. A system according to claim 1 wherein said second track is a siding track.

3. A system according to claim 2 wherein said siding track leads to an elevator having a car frame disposed in a hoistway, said car frame having rails extending in a direction to be coaligned with rails of one of said bogies on said second track when said bogie is at rest adjacent said elevator, said car frame and said passenger cab comprising means for transferring said passenger cab between said bogie and said car frame.

4. A system according to claim 2 further comprising a passenger landing adjacent said second track.

5. A system according to claim 2 further comprising a third track disposed immediately adjacent said second track on the opposite side thereof from said first track, said third track extending between third and fourth destinations and having at least one of said bogies thereon.

6. A system according to claim 1 wherein said second track comprises a track extending between third and fourth destinations and having one of said bogies disposed thereon.

7. A method of transferring a passenger cab from a train of horizontal transport bogies moving on a main track between a pair of destinations, to a passenger landing without stopping said train, comprising:

providing a siding track immediately adjacent said main track and extending to said landing;

providing a horizontal transport auxiliary bogie on said siding track;

providing a passenger cab adapted to be moved between one of said bogies and another of said bogies and between one of said bogies and said landing;

accelerating said auxiliary bogie on said siding track to a speed equal to the speed of said train with said auxiliary bogie immediately adjacent said cab;

moving said passenger cab transversely from one of said bogies of said train to said auxiliary bogie; and decelerating said auxiliary bogie to a stop immediately adjacent said passenger landing.

8. A method of transferring a passenger cab from a first train of horizontal transport bogies traveling on a first track between a first pair of destinations and a second train of horizontal transport bogies traveling on a second track between a second pair of destinations, without stopping either of said trains, comprising:

providing an empty horizontal transport bogie in said second train;

providing a passenger cab adapted to be moved between one of said bogies and another of said bogies and between one of said bogies and said landing;

operating said trains at a mutually identical speed with said cab immediately adjacent said empty bogie; and transferring said passenger cab transversely from said first train to said second train.

9. A method of transferring a passenger cab from a train of horizontal transport bogies moving on a main track between a pair of destinations, to a passenger elevator in a building having a cab-carrying car frame, without stopping said train, comprising:

providing a siding track immediately adjacent said main track and extending to said elevator;

providing a horizontal transport auxiliary bogie on said siding track;

providing a passenger cab adapted to be moved between one of said bogies and another of said bogies and between one of said bogies and said car frame;

accelerating said auxiliary bogie on said siding track to a speed equal to the speed of said train with said auxiliary bogie immediately adjacent said passenger cab;

moving said passenger cab transversely from said train to said auxiliary bogie;

decelerating said auxiliary bogie to a stop immediately adjacent said passenger elevator; and transferring said passenger cab from said auxiliary bogie to said car frame in said passenger elevator.

10. A method of transferring a passenger cab from a first train of horizontal transport bogies moving on a first track between a first pair of destinations, to a second train of horizontal transport bogies moving on a second track between a second pair of destinations, without stopping said trains, comprising:

(a) providing a siding track extending a distance immediately adjacent said first track and extending a distance immediately adjacent said second track;

(b) providing a horizontal transport auxiliary bogie on said siding track;

(c) providing an empty horizontal transport bogie in said second train;

(d) accelerating said auxiliary bogie on said siding track to a speed equal to the speed of said first train with said auxiliary bogie immediately adjacent said passenger cab;

(e) moving said passenger cab transversely from said first train to said auxiliary bogie;

(f) operating said auxiliary bogie on said siding track to a speed equal to the speed of said second train with said auxiliary bogie immediately adjacent said empty bogie; and (g) moving said passenger cab transversely from said auxiliary bogie to said empty bogie.

11. A method of transferring a passenger cab from a first train of horizontal transport bogies moving on a first track between a first pair of destinations, to a second train of horizontal transport bogies moving on a second track between a second pair of destinations, without stopping said trains, comprising:

(a) providing a siding track extending a distance immediately adjacent said first track and extending a distance immediately adjacent said second track;

(b) providing a horizontal transport auxiliary bogie on said siding track;

(c) providing an empty horizontal transport bogie in said second train;

(d) accelerating said auxiliary bogie on said siding track to a speed equal to the speed of said first train with said auxiliary bogie immediately adjacent said passenger cab;

(e) moving said passenger cab transversely from said first train to said auxiliary bogie;

(f) then decelerating said auxiliary bogie to a stop;

(g) causing said bogie to wait;

(h) accelerating said auxiliary bogie on said siding track to a speed equal to the speed of said second train with said auxiliary bogie immediately adjacent said empty bogie; and (i) moving said passenger cab transversely from said auxiliary bogie to said empty bogie.

* * * * *